US006703354B2

(12) United States Patent
Akiyama

(10) Patent No.: US 6,703,354 B2
(45) Date of Patent: Mar. 9, 2004

(54) ANTICORROSIVE LUBRICANT COMPOSITION FOR MOLDED PLASTIC PRODUCTS AND MOLDED PLASTIC PRODUCTS WITH SAME APPLIED THERETO

(75) Inventor: Motoharu Akiyama, Nagano-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 09/821,315

(22) Filed: Mar. 29, 2001

(65) Prior Publication Data

US 2002/0052299 A1 May 2, 2002

(30) Foreign Application Priority Data

Sep. 1, 2000 (JP) ..... 2000-266047

(51) Int. Cl.[7] ..... C10M 135/10

(52) U.S. Cl. ..... 508/390; 252/386; 106/14.05; 106/14.41; 106/14.42; 106/14.43

(58) Field of Search ..... 508/390; 252/386; 106/14.05, 14.41, 14.42, 14.43

(56) References Cited

U.S. PATENT DOCUMENTS 4,290,912 A * 9/1981 Boerwinkle et al. ..... 106/14.41
5,227,082 A * 7/1993 Pillon et al. ..... 252/390
5,250,122 A 10/1993 Uchida et al.
5,958,850 A * 9/1999 Matsuzaki et al. ..... 508/435

FOREIGN PATENT DOCUMENTS

| | | |
|---|---|---|
| EP | 544 933 | 6/1993 |
| EP | 564 242 | 10/1993 |
| EP | 578 435 | 1/1994 |
| JP | 60031598 | * 2/1985 |
| WO | WO87/05927 | 10/1987 |
| WO | WO91/03533 | 3/1991 |

* cited by examiner

*Primary Examiner*—Jacqueline V. Howard
(74) *Attorney, Agent, or Firm*—Flynn, Thiel, Boutell & Tanis, P.C.

(57) ABSTRACT

The invention provides an anticorrosive lubricant composition for molded plastic products, causing no chemical attack to mechanical components such as gears, shafts, and so forth, formed of molded resins, even if used therefor, and also provides mechanical components such as gears, shafts, and so forth, to which the same is applied. The anticorrosive lubricant composition for molded plastic products contains 100 parts by weight of a synthetic hydrocarbon oil having kinematic viscosity of 10 to 500 $mm^2/s$ at 40° C., and 0.1 to 10 parts by weight of a corrosion prevention additive.

5 Claims, 1 Drawing Sheet

ANTICORROSIVE LUBRICANT COMPOSITION FOR MOLDED PLASTIC PRODUCTS AND MOLDED PLASTIC PRODUCTS WITH SAME APPLIED THERETO

BACKGROUND OF THE INVENTION

1. Field of the Invention

The present invention relates to an anticorrosive lubricant oil composition for molded plastic products, and molded plastic products with the same applied thereto. More specifically, the invention is concerned with an anticorrosive lubricating oil for molded plastic products, which prevents chemical attack from occurring to mechanical components such as gears, shafts, and so forth, formed of molded resins, even if used therefor, and with mechanical components such as gears, shafts, and so forth, to which the same is applied.

2. Related Art

Molded resins of polycarbonate resins, ABS resins, polystyrene resins, polycarbonate-ABS resins, and so forth have been in widespread use lately for mechanical components such as gears, shafts, and so forth of copying machines, facsimile machines, toys, and so on because of their mechanical strength, light weight, and low cost, by themselves or in combination with mechanical components made of metal.

Anticorrosive lubricant compositions prepared by adding an anticorrosive to an ester oil or a diester oil, or to a lubricating oil containing a mineral oil as a major constituent thereof have been in use for corrosion prevention and lubrication of these mechanical components.

It has recently turned out however that the anticorrosive lubricant compositions prepared by adding an anticorrosive to an ester or a diester have an effect called chemical attack on plastic products, thereby causing damages and cracks to the mechanical components such as gears, shafts, and so forth, made of plastics.

It is therefore an object of the invention to provide an anticorrosive lubricant oil composition for molded plastic products, causing no chemical attack to the mechanical components such as gears, shafts, and so forth, made of plastic products, and to provide molded plastic products with the anticorrosive lubricant composition applied thereto.

More specifically, the invention is intended to provide an anticorrosive lubricant oil composition exhibiting desirable effects, particularly, on molded resin products, made of resins selected from the group consisting of polycarbonate resins, ABS resins, polystyrene resins, and polycarbonate-ABS resins.

SUMMARY OF THE INVENTION

The inventor has continued intensive studies for solving the problem described above, and has discovered the fact that a composition, containing a synthetic hydrocarbon oil having a kinematic viscosity of 10 to 500 $mm^2/s$ at 40° C., particularly, a poly α-olefin as a major constituent, and combined with an anticorrosive, does not cause any chemical attack to molded plastic products, and has succeeded in developing the invention. In particular, a sulfonate based anticorrosive is desirable as the anticorrosive used in carrying out the invention.

DESCRIPTION OF THE PREFERRED EMBODIMENT

Figure 1:
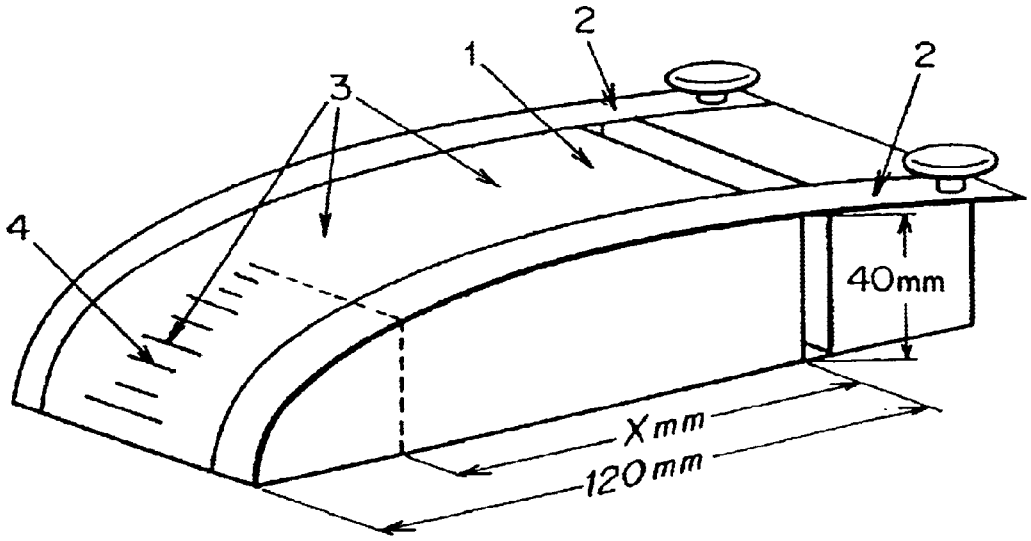
FIG. 1 is a perspective view of an apparatus used in conducting a quarter elliptical testing method.

As a synthetic hydrocarbon oil having a kinematic viscosity of 10 to 500 $mm^2/s$ at 40° C., used in carrying out the invention, there are available polybutene and poly α-olefins. In particular, poly α-olefins can be suitably used.

With a kinematic viscosity of not more than 10 $mm^2/s$ at 40° C., there will be no effect of preventing chemical attack while with a kinematic viscosity of not less than 500 $mm^2/s$ at 40° C., workability will deteriorate.

For the poly α-olefin, used in carrying out the invention, there are cited oligomers including a dimer, trimer, tetramer, and so forth, such as 1-octane, 1-nonane, 1-decene, 1-dodecene, 1-tridecene, 1-tetradecene, 1-pentadecene, 1-hexadecene 1-heptadecene, 1-octadecene, 1-nonadecene, 1-eicosane 1-docosane, and so forth.

Particularly desirable is an oligomer (referred to hereinafter as a PAO) such as a dimer, trimer, tetramer, and so forth, of decene-1, as expressed by the general formula

[1]

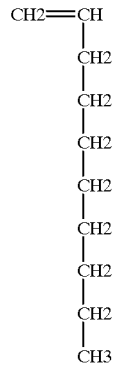

DECENE-1
C10H20 mol wt 140.27

An anticorrosive can be broadly classified into a non-adsorption type anticorrosive, and an adsorption type anticorrosive. The non-adsorption type anticorrosive is one for checking a corrosion rate by actively oxidizing and stabilizing (passivating) only a thin surface layer of a metal while the adsorption type anticorrosive is one for preventing initiation of corrosion by forming an anticorrosive film made up of an adsorption layer and an oil film of the anticorrosive, thereby preventing permeation of water and oxygen, and isolating the surface of a metal from a corrosive environment.

For the anticorrosive used in carrying out the invention, there is available either the adsorption type or the non-adsorption type, and for the adsorption type, there can be cited a sulfonate based anticorrosive, a sorbitan ester based anticorrosive, a carboxylic acid based anticorrosive, a carboxylate based anticorrosive, an amine based anticorrosive, a phosphorus based anticorrosive, and a phosphate based anticorrosive.

For the sulfonate based anticorrosive used in the invention, there are available Li-sulfonate, Ba-sulfonate, Ca-sulfonate, Zn-sulfonate, and the like, for the amine based anticorrosive, there are available octadecenylamine, cyclohexylamine, and the like, and for the phosphorus based anticorrosive, there are available tri-P-cresyl phosphate, cetyl methyl azide phosphate, and the like.

For the sorbitan ester based anticorrosive used in the invention, there are available sorbitan monolaurate, sorbitan trilaurate, sorbitan monostearate, sorbitan tristearate, sorbitan monooleate, sorbitan trioleate, and so forth, and there are also available one kind of mixture or not less than two kinds of mixtures of these salts.

For the carboxylic acid based anticorrosive, there are available undecanoic acid, myristic acid, stearic acid, dodecyl phenyl stearic acid, p-n-dodecyl hydroxybenzoic acid, α-hydroxypalmitic acid, and the like, and for the carboxylate based anticorrosive, there are available Zn-laurate, Zn-naphthenate, Ba-phenylstearate, Ca-naphthenate, and so forth.

In particular, the adsorption type anticorrosive preferably used in carrying out the present invention is the sulfonate based anticorrosive, particularly one based on Zn-sulfonate, Ba-sulfonate, Ca-sulfonate, or Li-sulfonate, and more specifically, one based on Zn-petroleum sulfonate, Ba-petroleum sulfonate, Ca-petroleum sulfonate, or Li-petroleum sulfonate, and so forth.

Further, the anticorrosive lubricant composition for molded plastic products, according to the invention, may include various stabilizers, antioxidants, surfactants, and so on, normally used by those skilled in the art, without departing from the spirit and scope of the invention. It will be obvious that non-adsorption type corrosion prevention additives may also be used.

The anticorrosive preferably used in carrying out the present invention is in the proportions of 0.1 to 10 parts by weight to 100 parts by weight of the synthetic hydrocarbon oil, and if the anticorrosive used is in the proportions of less than 0.1 parts by weight, there will be hardly any effect of corrosion prevention while if the same is in the proportions in excess of 10 parts by weight, this will not only deteriorate lubricity but also will be undesirable economically.

Now, preferred embodiments of the invention are described hereinafter:

(1) an anticorrosive lubricant composition for molded plastic products, containing 100 parts by weight of a synthetic hydrocarbon oil having a kinematic viscosity of 10 to 500 $mm^2/s$ at 40° C., and 0.1 to 10 parts by weight of a corrosion prevention additive;

(2) the anticorrosive lubricant composition for molded plastic products, as set forth under (1) above, wherein the synthetic hydrocarbon oil is a poly α-olefin;

(3) the anticorrosive lubricant composition for molded plastic products, as set forth under item (1) or (2) above, wherein the poly α-olefin is a mixture of one kind or not less than two kinds, selected from the group of oligomers of dencene-1 such as a dimer, trimer, tetramer, and so forth, of decene-1;

(4) the anticorrosive lubricant composition for molded plastic products, as set forth under any one of items (1) to (3) above, wherein the corrosion prevention additive is a sulfonate based anticorrosive;

(5) the anticorrosive lubricant composition for molded plastic products, as set forth under any one of items (1) to (4) above, wherein the sulfonate based anticorrosive is one kind or not less than two kinds, selected from the group consisting of Li-sulfonate, Ba-sulfonate, Ca-sulfonate, and Zn-sulfonate;

(6) molded plastic products to which the anticorrosive lubricant composition for molded plastic products, as set forth under any one of items (1) to (5) above, is applied, and which is composed of one kind of resin or not less than two kinds of resins, selected from the group consisting of polycarbonate resins, ABS resins, polystyrene resins, and polycarbonate-ABS resins; and (7) the molded plastic products as set forth under item (6) above, wherein the molded plastic products are mechanical components such as gears, shafts, and so forth.

EXAMPLES

The invention is described in more detail hereinafter based on the following examples.

Examples of anticorrosive lubricant compositions, 1 to 7.

For a poly α-olefin, use was made of a PAO, with which various sulfonate based anticorrosives were mixed in a vessel in the proportions shown in Table 1, and mixtures thus obtained were homogenized, thereby obtaining anticorrosive lubricant compositions.

Table 1 shows the constituent ratio and corrosion prevention effect of the respective anticorrosive lubricant compositions.

TABLE 1

| | corrosion prev'tion additive | addition amount wt. parts (%) | kind of lubricating oil | kinem'tic viscosity $mm^2/s$ (at 40° C.) | corrosion prevention effect |
|---|---|---|---|---|---|
| example 1 | Zn-s'lfonate | 3.0 | PAO | 30 | ◎ |
| example 2 | Zn-s'lfonate<br>sorbitol stearate | 2.5<br>2.5 | PAO | 48 | ◎ |
| example 3 | Zn-s'lfonate<br>sorbitol stearate | 1.5<br>1.5 | PAO | 48 | ◎ |
| example 4 | Zn-s'lfonate<br>sorbitol stearate | 0.5<br>0.5 | PAO | 48 | ◎ |
| example 5 | Zn-s'lfonate | 0.5 | PAO | 405 | ○ |
| example 6 | Ca-s'lfonate | 0.5 | PAO | 405 | ○ |
| example 7 | Li-s'lfonate | 0.5 | PAO | 405 | ○ |
| example 8 | Ba-s'lfonate | 0.5 | PAO | 405 | ○ |
| comp. example | Zn-s'lfonate | 3.0 | diester | 30 | ◎ |

Remark: corrosion-prev'tion additive, kinem'tic viscosity, and s'lfonate stand for corrosion prevention additive, kinematic viscosity, and sulfonate, respectively

Comparative Example

For the comparative purpose, a case is shown where use is made of a diester based lubricating oil which has been in use in the past.

Embodiments of the anticorrosive lubricant compositions:

The anticorrosive lubricant composition according to the examples 1 to 8 is applied to plastic testpieces, and the results of tests, indicating occurrence of cracks, are shown in Table 2.

TABLE 2

| | polycarbonate resins | ABS resins | polystyrene resins | polycarbonate - ABS resins |
|---|---|---|---|---|
| example 1 | A | A | A | A |
| example 2 | A | B | A | B |

TABLE 2-continued

| | polycarbonate resins | ABS resins | polystyrene resins | polycarbonate - ABS resins |
|---|---|---|---|---|
| example 3 | A | A | A | A |
| example 4 | A | A | A | B |
| example 5 | A | A | A | A |
| example 6 | A | A | A | A |
| example 7 | A | A | A | A |
| example 8 | A | A | A | A |
| comp. example | D | D | D | D |

Crack tests were conducted under the following test conditions by use of a quarter elliptical testing method using an apparatus shown in FIG. 1.

1. an ellipse: $(X/12)^2+(Y/4)^2=1$
2. testpiece: 35 mm×120 mm×2 mm
3. test conditions: the testpieces to which the respective anticorrosive lubricant compositions were applied were left as they were at 20° C. for 4 hours.
4. evaluation: after the tests, the anticorrosive lubricant compositions were removed, the testpieces were bent, and crack conditions were observed by use of a microscope, thereby determining an evaluation on the crack condition of the respective testpieces.

More specifically, a testpiece 1 was placed on the elliptical surface of a quarter elliptical testing apparatus shown in FIG. 1, and securely held with bands 2 fixed along the elliptical surface. Thereafter, an anticorrosive lubricant composition 3 for molded plastic products was applied to the testpiece 1, and the testpiece with the anticorrosive lubricant composition 3 applied thereto was left as it was at 20° C. for the duration of 4 hours, whereupon portions of the elliptical surface ranging from slightly warped ones to largely warped ones were artificially formed, and thereby the conditions of cracks 4 occurring to the elliptical surface were observed by use of a microscope for determining evaluation.

The evaluation on the crack conditions was made through ranking in the following four stages:

A indicates an excellent surface condition without any crack occurring thereto;

B indicates a surface condition wherein cracks occurring to largely warped portions only of the surface were observed, demonstrating that the testpiece is fit for normal use;

C indicates a surface condition wherein cracks occurring to relatively largely warped portions only of the surface were observed, demonstrating that the testpiece is fit for use under given conditions; and D indicates a surface condition wherein cracks occurring to even slightly warped portions of the surface were observed, demonstrating that the testpiece is not fit for use.

The evaluation on the corrosion prevention effect was made through ranking in the following three stages:

◎ indicates an excellent corrosion prevention effect;

○ indicates a good corrosion prevention effect; and

Δ indicates an ordinary corrosion prevention effect.

Thus, it has been confirmed that as is evident from Tables 1 and 2, the testpieces made of plastics treated with the respective anticorrosive lubricant compositions for molded plastic products, according to the invention, are capable of checking the occurrence of cracks to a large extent in comparison with the testpieces made of plastics, treated with the conventional anticorrosive lubricant compositions for molded plastic products.

What is claimed is:

1. An anticorrosive lubricant oil composition for molded plastic products, consisting essentially of 100 parts by weight of a synthetic hydrocarbon oil having a Kinematic viscosity of 10 to 500 $mm^2/s$ at 40° C. and 0.1 to 10 parts by weight of a corrosion prevention additive wherein said synthetic hydrocarbon oil is at least one member selected from the group consisting of oligomers of decene-1 and said corrosion prevention additive is a sulfonate based anticorrosive.

2. An anticorrosive lubricant oil composition for molded plastic products according to claim 1, wherein said sulfonate based anticorrosive is at least one member selected from the group consisting of Li-sulfonate, Ba-sulfonate, Ca-sulfonate, and Zn-sulfonate.

3. Molded plastic products to which said anticorrosive lubricant oil composition for molded plastic products according to claim 1 is applied, and which is composed of at least one resin selected from the group consisting of polycarbonate resins, ABS resins, polystyrene resins, and polycarbonate-ABS resins.

4. Molded plastic products according to claim 3, wherein said molded plastic products are mechanical components including gears, and shafts.

5. A method of preventing corrosion and cracking in a molded plastic product comprising the step of applying an anticorrosive lubricant oil composition consisting essentially of 100 parts by weight of a synthetic hydrocarbon oil having a kinematic viscosity of 10 to 500 $mm^2/s$ at 40° C. and 0.1 to 10 parts by weight of a corrosion prevention additive to a surface of the molded plastic product wherein said synthetic hydrocarbon oil is at least one member selected from the group consisting of oligomers of decene-1 and said corrosion prevention additive is a sulfonate based anticorrosive.

* * * * *